US005847518A

United States Patent [19]

Ishiwaki

[11] Patent Number: 5,847,518

[45] Date of Patent: Dec. 8, 1998

[54] HIGH VOLTAGE TRANSFORMER WITH SECONDARY COIL WINDINGS ON OPPOSING BOBBINS

[75] Inventor: Masao Ishiwaki, Tottori-ken, Japan

[73] Assignee: Hitachi Ferrite Electronics, Ltd., Tottori, Japan

[21] Appl. No.: 886,455

[22] Filed: Jul. 1, 1997

[30] Foreign Application Priority Data

| | | | |
|---|---|---|---|
| Jul. 8, 1996 | [JP] | Japan | 8-198393 |
| Jan. 17, 1997 | [JP] | Japan | 9-019705 |
| Feb. 28, 1997 | [JP] | Japan | 9-062121 |

[51] Int. Cl.[6] ..... H05B 41/16

[52] U.S. Cl. ..... 315/276; 315/278; 336/182

[58] Field of Search ..... 315/276, 278; 336/182, 184

[56] References Cited

U.S. PATENT DOCUMENTS

| | | | |
|---|---|---|---|
| 3,489,975 | 1/1970 | D'Entremont | 336/182 |
| 4,187,450 | 2/1980 | Chen | 315/278 |
| 5,550,437 | 8/1996 | Hopkins et al. | 315/276 X |

FOREIGN PATENT DOCUMENTS

| | | |
|---|---|---|
| 5-159944 | 6/1993 | Japan . |
| 7-45393 | 2/1995 | Japan . |
| 8-70543 | 3/1996 | Japan . |
| 8-130127 | 5/1996 | Japan . |

*Primary Examiner*—Robert Pascal
*Assistant Examiner*—Justin P. Bettendorf
*Attorney, Agent, or Firm*—Finnegan, Henderson, Farabow, Garrett & Dunner

[57] ABSTRACT

A high voltage transformer comprising a core with a closed magnetic flux path formed by at lease two core parts, at least two bobbins mounted on the side legs of the core, a primary coil and a secondary coil. The bobbin has a hollow through hole to receive the side leg, a low voltage side flange and a high voltage side flange at end portions. The primary coil is inserted in the low voltage side flange, and the secondary coil is regularly and orderly wound on the bobbin between the low voltage side flange and the high voltage side flange. The winding direction of the secondary coil of one of the bobbins is opposite to that of the secondary coil of the other bobbin. The regularly and orderly wound coil and the opposite winding directions decrease the potential difference between the adjacent turns in the second coil and minimize the potential difference between the opposing turns of the secondary coils which are placed parallel to each other. As a result thereof, an internal short-circuiting of a high voltage transformer due to the discharge between the adjacent turns or the opposing turns can be effectively prevented.

13 Claims, 9 Drawing Sheets

HIGH VOLTAGE TRANSFORMER WITH SECONDARY COIL WINDINGS ON OPPOSING BOBBINS

BACKGROUND OF THE INVENTION

The present invention relates to a transformer producing a high secondary voltage for use in energizing a high iluminescence discharge (HID) lamp such as a mercury lamp, a metal halide lamp, a cold cathode lamp, etc. which are used in a liquid crystal projector, an automotive headlight, an overhead projector, etc.

FIG. 16 shows a high voltage transformer conventionally used in the art. A rectangular core 60 is constructed by combining two pieces of U-shaped magnetic core 65 made of a magnetic material. A bobbin 66 on which a primary coil 61 and a secondary coil 63 are wound is mounted on one of the side legs of the rectangular core 60. To avoid a short circuit and burnout due to a potential difference between the high voltage secondary coil 63 and the U-shaped core 65 or the low voltage primary coil 61, the secondary coil 63 and the primary coil 61 are kept apart from each other by an insulating distance C. In addition, the discharge due to the potential difference is prevented by sealing the coils with an insulating resin 69. However, since the bobbin 66 is mounted on only one of the side legs of the rectangular core 60, the secondary coil 63 should be kept apart from the other side leg of the rectangular core 60 by an insulating distance C' through an insulating material, this making the transformer unfavorably larger in its size.

The cold cathode lamp has been used as a backlight for a liquid crystal display. In a cold cathode lamp circuit, a primary voltage of several tens volt is changed to several kilos volt by a high voltage transformer to energize the cold cathode lamp. FIG. 17 is a conventional high voltage transformer used for energizing a cold cathode lamp, and FIG. 18 is a bottom plan view thereof. A bobbin 103 has flanges 101, 101' at both the end portions and a hollow through hole 102 to which a core 107 is inserted. Between the flanges 101, 101', a primary coil 104 and a secondary coil 105 are wound. The primary coil 104 and the secondary coil 105 are kept apart from each other by an insulating wall 106*a*, and the secondary coil 105 is divided to four windings by insulating walls 106*b*. The ends of the primary coil 104 and the secondary coil 105 are connected to respective terminals 110, 111, 111' on each of the flanges 108, 108'. However, when applied to a discharge lamp circuit where a secondary voltage of about 25 kV is required, this type of transformer has been found to involve the following several problems:

(1) Since the secondary voltage is extremely higher, the potential difference in the divided windings of the secondary coil 105 is too large. This deteriorates the reliability of the transformer. Although the potential difference can be reduced by dividing the secondary coil 105 into a more increased number of divided windings, this makes the size of the transformer larger.

(2) As shown in FIG. 18, one of the ends of the secondary coil 105 extends along the axial direction of the secondary coil 105 and is connected to the secondary terminal 111. Therefore, the high potential difference in the coil requires an insulating distance (a) larger than those employed in the conventional transformer, this making the size of transformer unfavorably larger.

(3) Since the voltage between the terminals 111, 111' of the secondary coil 105 is about 25 kV, the insulating distance (b) should be sufficiently large to avoid the discharge between the terminals 111 and 111', this also making the size of transformer unfavorably larger.

Recently, a high voltage discharge lamp such as a metal halide lamp has been used for the automotive headlight. The metal halide lamp is highly luminous and can throw light on objects more rightly as compared with the conventional automotive headlight utilizing a halogen lamp. However, the metal halide lamp requires a high voltage of 20 to 30 kV or higher at the start of discharge, in particular, at the restart of discharge immediately after the light-out. In the transformer producing such a high secondary voltage, a specific consideration is required to prevent the discharge between the adjacent turns in the secondary coil because the potential difference between the adjacent turns reaches 100 V to several hundreds volt. In addition, since a large current of about 5 A flows in the transformer, the wire for the secondary coil should have a sufficiently large cross sectional area tolerable to such a large current.

An example for a high voltage transformer for use in a high voltage discharge lamp circuit has been disclosed in Japanese Patent Laid-Open No. 8-130127 as shown in FIG. 19. A spool 118 interiorly contains a cylindrical core 119, and secondary coils 117 are wound around the spool 118. The spool 118 and the secondary coils 117 are sealed in a casing 120 with a sealing resin. An arch-shaped flat primary coil 122 is mounted on the casing 120 from the upper side to cover the spool 118, the secondary coils 117, and the core 119. In this transformer, the potential difference in coil is kept small by dividing the coil into three divided windings. However, the potential difference in each divided winding is still high when a secondary voltage of about 25 kV is intended. In addition, since the magnetic core is constructed only by the cylindrical core 119, the transformer is open with respect to the magnetic flux path. The core with an open magnetic flux path requires an increased number of turns of the coil to produce a high voltage of the desired level or requires a large core size to obtain necessary characteristics, thereby causing problems of an increased weight and a large mounting area. In addition, the magnetic flux leaking from the transformer causes serious problems on the other elements around the transformer when assembled in automotive units.

Thus, in the high voltage transformer producing an output voltage of about 25 kV from an input voltage of about 1 kV, it has been very important to take a measure on insulation to counter the high output voltage. However, this inevitably leads to an increased size and weight of the transformer in the known transformers.

OBJECT AND SUMMARY OF THE INVENTION

Accordingly, an object of the present invention is to provide a high voltage transformer of a reduced size and a reduce weight minimizing accidents due to the discharge between the adjacent turns in the coil and between the coils.

As a result of the intense research in view of the above objects, the inventors have found that the potential difference between the adjacent turns in a secondary coil can be reduced by regularly and orderly winding the secondary coil. The inventors have further found that the potential difference between the opposing turns of the secondary coils disposed parallel to each other can be minimized by winding the secondary coils in the opposite directions. The present invention has been accomplished based on these findings.

Thus, in a first aspect of the present invention, there is provided a high voltage transformer comprising (1) a core with a closed magnetic flux path formed by at lease two core parts, the core having at least two parallel side legs; (2) at least two bobbins mounted on the at least two side legs, the bobbin comprising a hollow through hole to receive the side leg, a low voltage side flange and a high voltage side flange at end portions of the bobbin; (3) a primary coil inserted in the low voltage side flange of each of the at least two bobbins; and (4) a secondary coil regularly and orderly wound on each of the at least two bobbins between the low voltage side. flange and the high voltage side flange, a winding direction of the secondary coil wound on one of the at least two bobbins being opposite to that of the secondary coil wound on the other bobbin.

BRIEF DESCRIPTION OF THE DRAWINGS

In the following drawings, like reference numerals indicate like parts.

DETAILED DESCRIPTION OF THE INVENTION

In the present invention, a core, preferably a rectangular or square core, with a closed magnetic flux path is used. A higher inductance can be obtained by a core with a closed magnetic flux path as compared with a core with an open magnetic flux path when the numbers of turns of coils are the same. Therefore, the number of turns can be reduced in the closed magnetic flux path system than in the open magnetic flux path system to attain an inductance of the same level. The core, which has at least two side legs parallel to each other, is constructed by suitably combining at least two core parts selected from the group consisting of U-shaped core part, L-shaped core part, E-shaped core part and I-shaped core part. Each core part may be a soft ferrite, preferably a highly resistant soft ferrite, selected from the group consisting of NiZn ferrite, NiCuZn ferrite, MgZn ferrite and MnMgZn ferrite. The soft ferrite may contain at least one oxide of Ti, Cr, Al, Sn, Li, Co, Pb, Bi, V, Si, Ca, etc. as additives or substituting components. Also, the soft ferrite is preferred to be of a low loss with respect to heat generation.

The shape of the cross section of the core is not specifically restricted and may be circular, oval, polygonal, semicircular, etc. The cross section may also include a notch of any shape. Further, the core may be constructed from the core parts having different cross sectional shapes. For example, a pair of opposite sides of the rectangular core may have a circular cross section and the other pair of opposite sides may have a polygonal cross section.

When a transformer with L-type non-linear superposing characteristics is intended, it is preferred to partially increase the magnetic resistance of the core by partially reducing the cross sectional area of the core, providing the core with a magnetic gap or forming a part of the core from a material having a small saturation magnetic flux.

Figure 11:
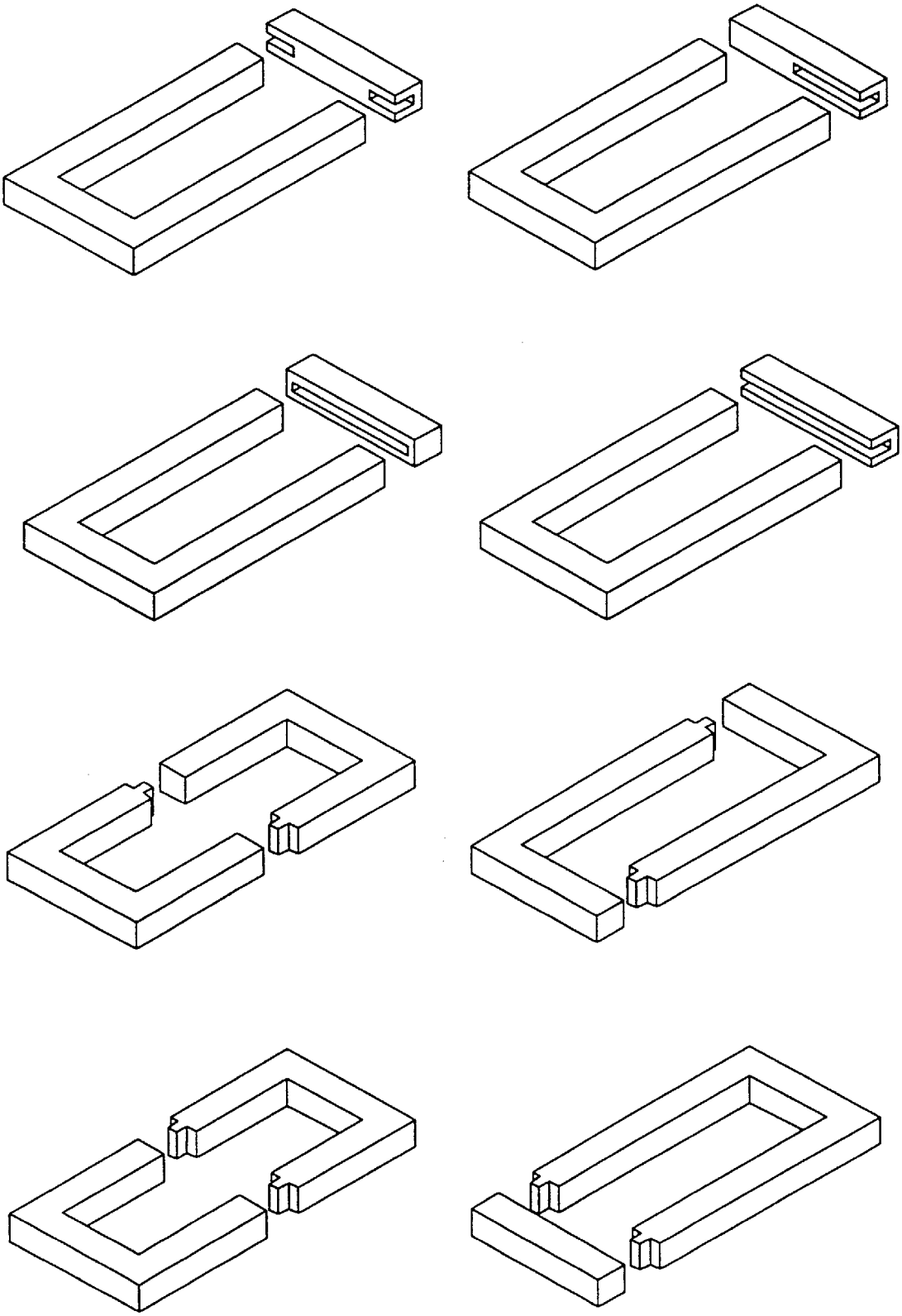
FIG. 11 is a schematic illustration showing several rectangular cored having a partially reduced cross sectional area.

For example, the cross sectional area of the core may be partially reduced as shown in FIG. 11. When the rectangular core is formed by U-shaped core part and I-shaped core part, a groove extending along the length direction of the I-shaped core is formed on the surface of the I-shaped core abutting the side legs of the U-shaped core. Such a groove may extend from one end to the other of the I-shaped core, or may be formed partly or discontinuously along the length direction. Alternatively, one or both ends of a core part may be machined to have a projecting portion as is also shown in FIG. 11. The reduced cross sectional area is preferably ⅔ or less, more preferably ½ or less and particularly preferably ¼ or less of the average sectional area of the other parts.

The magnetic gap or gaps may be formed at any position of the core. The gap spacing is also not specifically limited, and preferably 0.05 to 5 mm for each gap.

On each of the side legs of the core with a closed magnetic flux path, a bobbin having a hollow through hole to receive the side leg of the core is mounted. The bobbin made of an insulating resin such as a phenol resin, etc. has flanges (low voltage side flange and high voltage side flange) at the both the ends thereof, one of which (low voltage side flange) has a slot or slots to receive a primary coil.

The primary coil preferably of about ¾ turn may be formed from a conductive wire or a conductive thin plate preferably having a U-shape.

Figure 6:
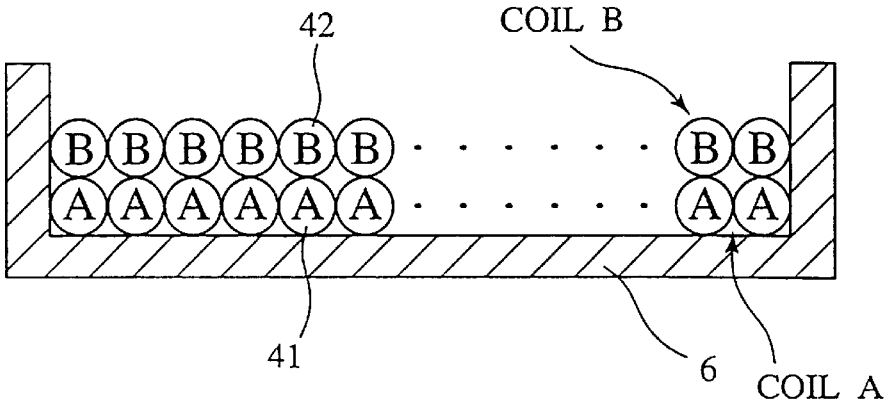
FIG. 6 is a schematic illustration showing a two-layered regular windings of the secondary coil.
Figure 7:
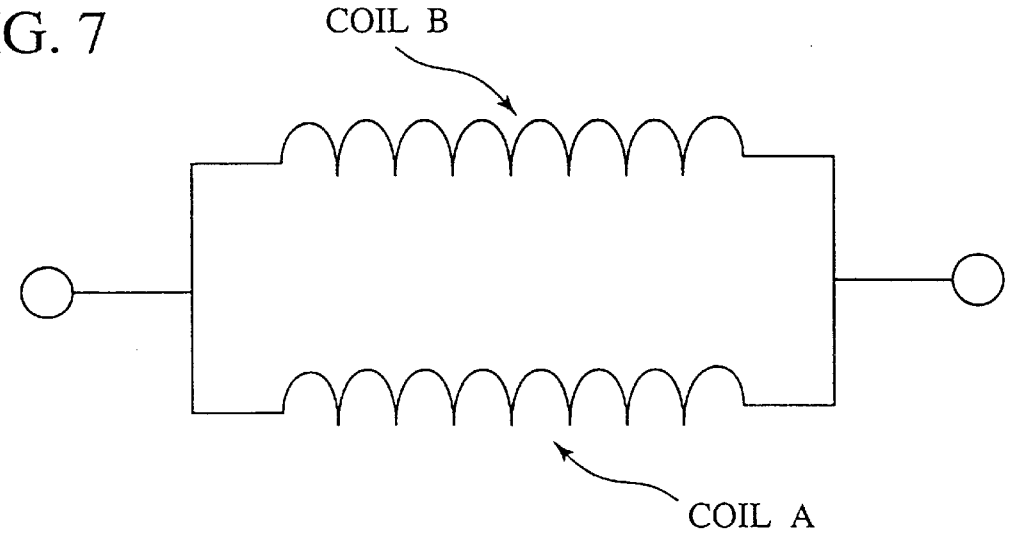
FIG. 7 is a circuit diagram showing the connection of the coil A and the coil B of FIG. 6.

A secondary coil is regularly and orderly wound around the bobbin between the low voltage side flange and the high voltage side flange. The term "regularly wound" or "orderly wound" referred to herein means that a wire for the secondary coil is wound around the bobbin in such a manner that any one of turns of the coil is not put on top of another turn and that each turn is closely arranged without leaving a gap between any of two adjacent turns as shown in FIG. 6 by a coil A or a coil B. When a secondary coil is wound randomly, a turn is likely to be put on top of another turn to cause the discharge between the overlapping turns.

The secondary coil may be a single layer of the regularly and orderly wound coil, or a multi layer, as shown in FIG.

6, comprising a plurality of the single layered regularly and orderly wound coils. In FIG. 6, the coil A is first regularly and orderly wound in a single layer on the bobbin 6, and then the coil B is regularly and orderly wound in a single layer on the coil A by a separate wire in the same direction as that of the coil A so that each turn of the coil B is positioned just above the turns of the coil A as shown in FIG. 6. The starting points of winding the coils A and B, and the end points of winding the coils A and B are respectively connected to each other. With this construction, since the electric capacity is doubled as compared with a single-layered coil and the direct-current resistance is reduced to one half that of the single-layered coil, a high electric capacity and a low direct-current resistance can be obtained by a thin wire without using a thick wire, this enabling to reduce the size of transformer. Although the multi-layered coil may comprise three or more layers of the single-layered regular windings, those containing two or three layers of the regular windings may be preferable in view of a reliable operation of the transformer. Also, by regularly and orderly winding each coil constituting each layer of the multi-layered structure, the potential difference between the vertically adjacent turns of the multi-layered coil, for example, the potential difference between a turn 41 of the coil A and a turn 42 of the coil B as shown in FIG. 6, can be minimized to effectively prevent the discharge between the vertically adjacent turns.

The wire for the secondary coil is not specifically limited and any wires used in the art such as a polyurethane enameled magnet wire, a polyethylene enameled magnet wire, etc. may be used in the art.

Figure 8:
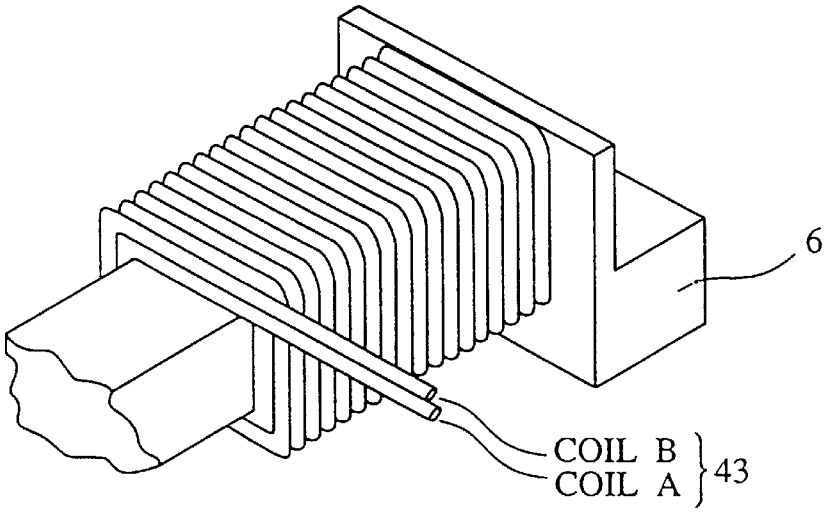
FIG. 8 is a schematic illustration showing a method for obtaining a two-layered regular windings.

FIG. 8 shows a method for easily obtaining a two-layered regularly wound coil. A flat integral parallel wire 43 is edgewisely wound on the bobbin 6 so that the wires for the coils A and B in the same turn are aligned vertically to the winding surface. By this method, a two-layered coil structure consisting of two single-layered regularly wound coils as shown in FIG. 6 is easily obtained. The integral parallel wire 43 may be formed by three separate wires.

Figure 1:
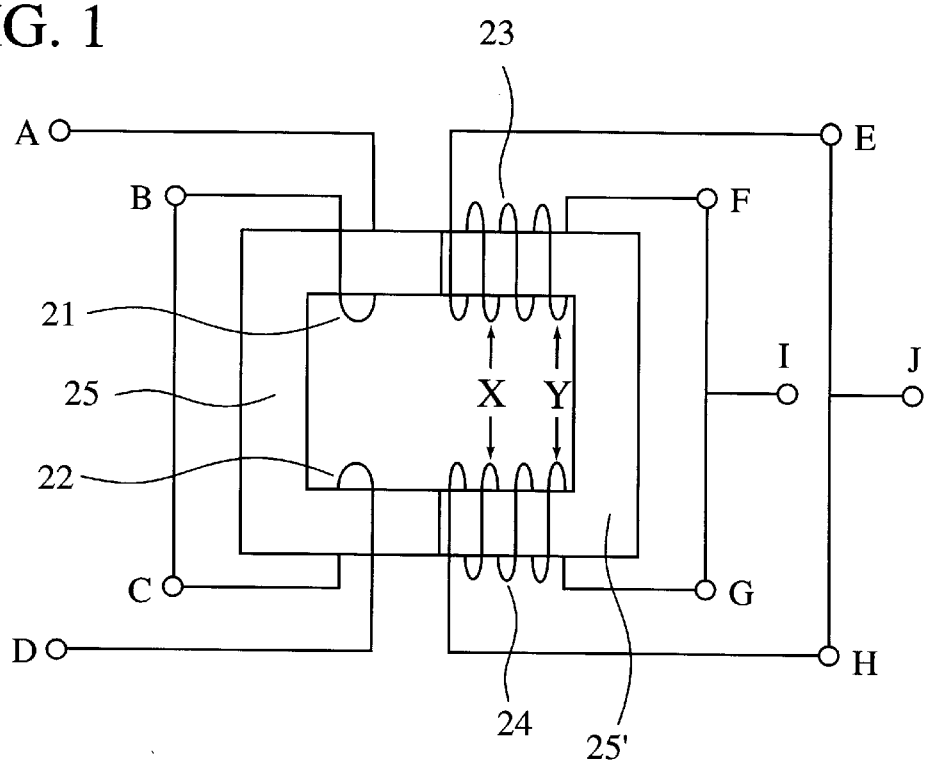
FIG. 1 is a schematic illustration showing one embodiment of the transformer according to the present invention.
Figure 2:
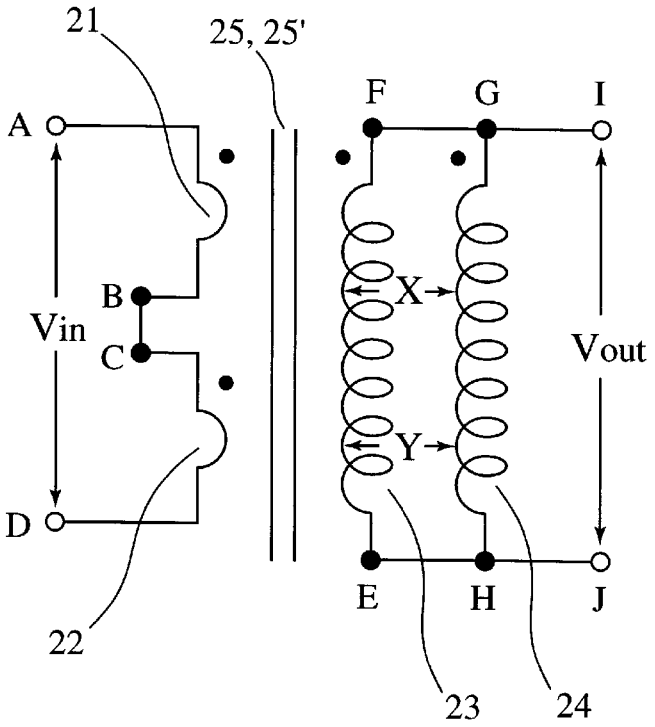
FIG. 2 is a circuit diagram of the transformer of FIG. 1.

FIG. 1 is a schematic illustration showing one embodiment of the transformer according to the present invention, and FIG. 2 is a circuit diagram of the transformer of FIG. 1. A rectangular core is made of two U-shaped core parts 25, 25'. Each input primary coil comprises a ¾ turn coil 21 or 22. The ¾ turn coils 21 and 22 are connected to each other in series at terminals B and C, and an input voltage Vin is applied between terminals A and D. Secondary coils 23 and 24 are wound in opposite directions and are connected to each other in parallel, and as a result thereof, the voltage increases from a terminal E to a terminal F in the coil 23 and from a terminal H to a terminal G in the coil 24. This means that a given point of the coil 23 and a point of the coil 24, which oppose to each other with the shortest distance, indicated by an arrow X have the same potential value. Also, a point of the coil 23 and a point of the coil 24 indicated by an arrow Y have the same potential value. Therefore, no discharge between the opposing points in different coils occurs, this avoiding an additional consideration of insulation between the coils to reduce the size of transformer.

As shown in FIGS. 1 and 2, in the present invention, at least two secondary coils are disposed in parallel on the side legs of the core. Since the secondary coils are connected in parallel to each other, an increased (doubled) electric capacity and a reduced (one half) direct-current resistance can be attained as compared with a transformer having only one secondary coil. Also, as described above, a more increased electric capacity and a more reduced direct-current resistance can be attained by constituting each secondary coil by a multi-layered structure of the regular windings. Thus, the transformer can be further reduced in its size according to the present invention.

To improve the dielectric resistance, heat resistance, weathering properties of the high voltage transformer, the assembly comprising the core, the bobbins mounted on the side legs of the core, the primary coils and the secondary coils each wound on the bobbins may be sealed in a casing made of polybutylene terephthalate, etc. with an insulating resin such as a polybutylene terephthalate, an epoxy resin, a polyphenylene oxide, a modified polyphenylene oxide, etc.

The high voltage transformer of the present invention described above has a small size of 20–25 mm×35–40 mm×20–25 mm (height) which is about ⅔ in terms of volume of the conventional transformer. Also, the high voltage transformer of the present invention shows a boosting ratio (Vout/Vin) of 10 to 200 and creates an output voltage of 10 to 50 kV.

Figure 15:
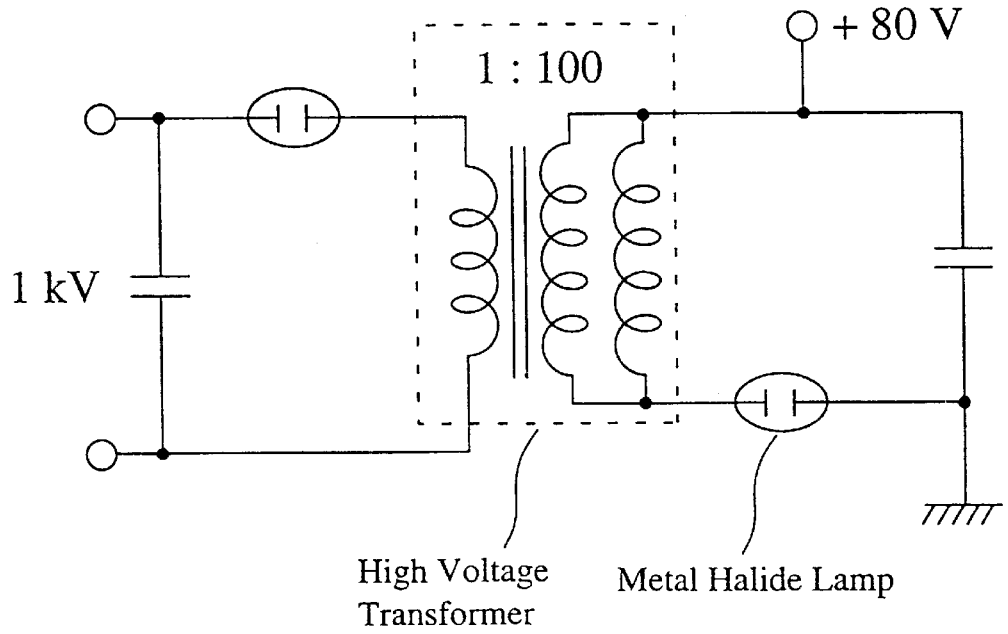
FIG. 15 is a circuit diagram showing a typical metal halide lamp circuit.
Figure 16:
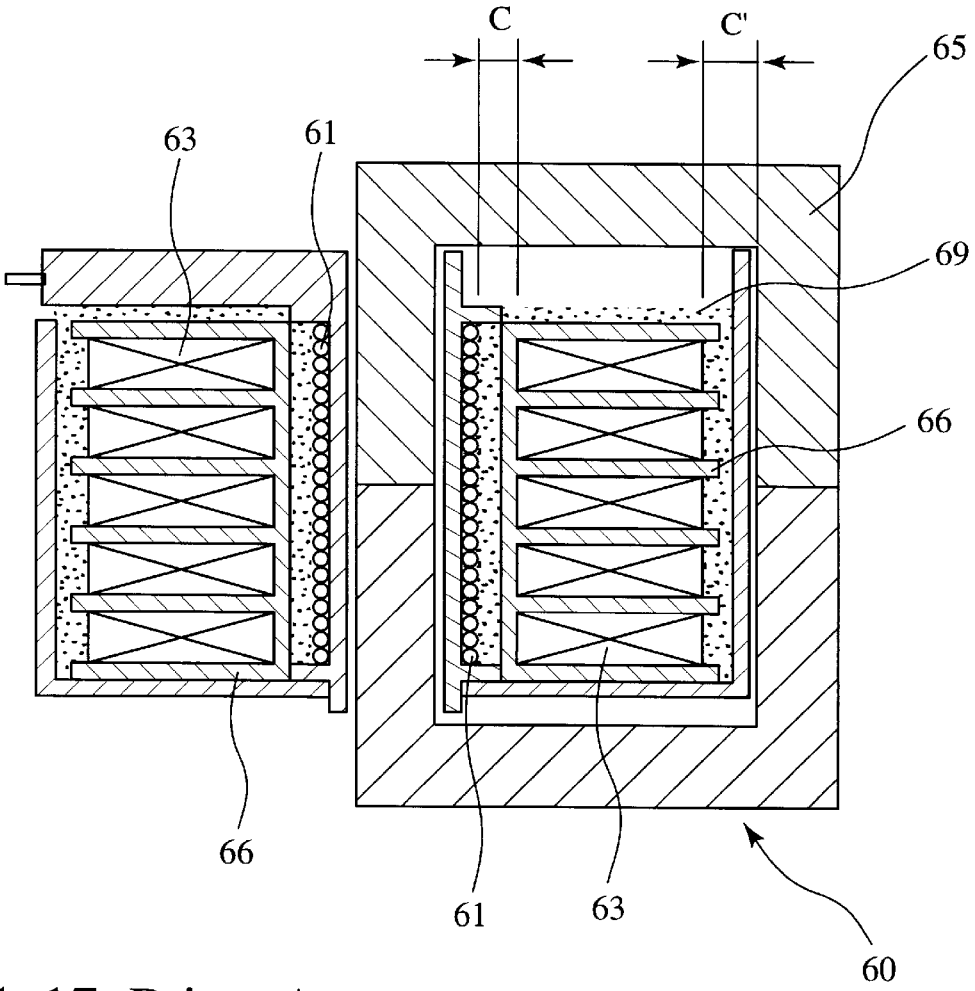
FIG. 16 Prior Art
FIG. 16 is a schematic cross sectional view showing a conventional high voltage transformer.
Figure 17:
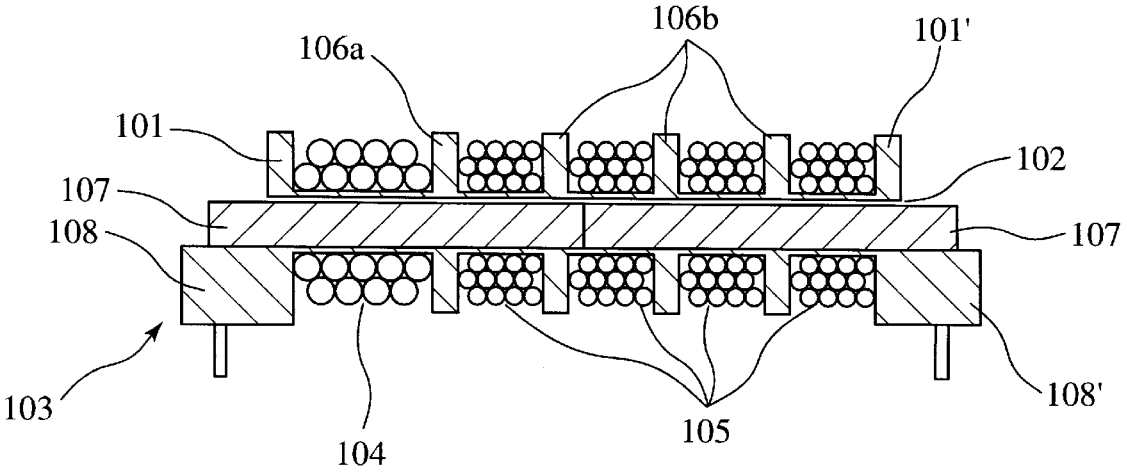
FIG. 17 Prior Art
FIG. 17 is a schematic cross sectional view showing another conventional high voltage transformer for use in a cold cathode lamp circuit.
Figure 18:
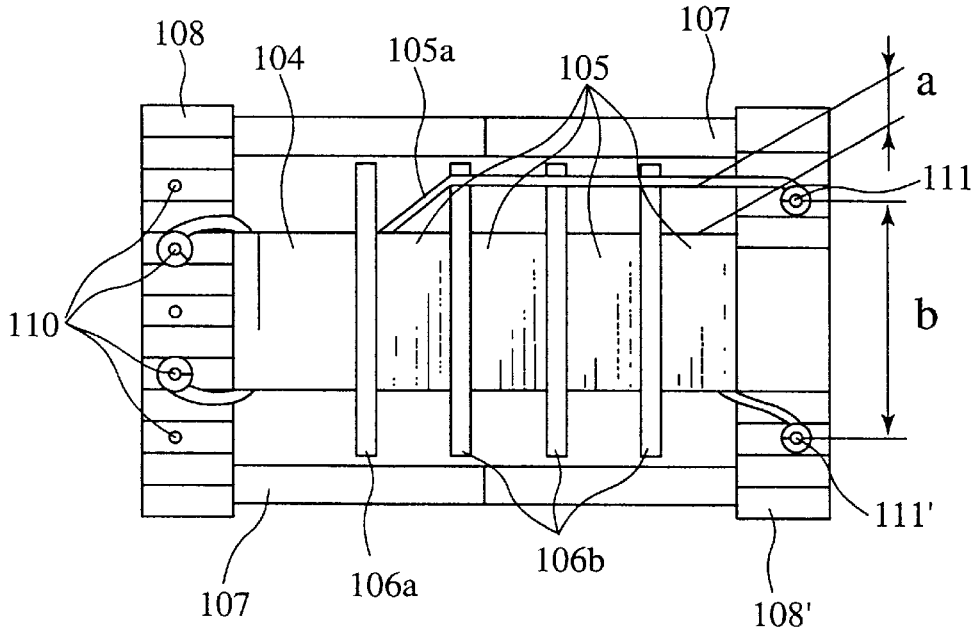
FIG. 18 Prior Art
FIG. 18 is a schematic bottom plan view of the transformer shown in FIG. 17.
Figure 19:
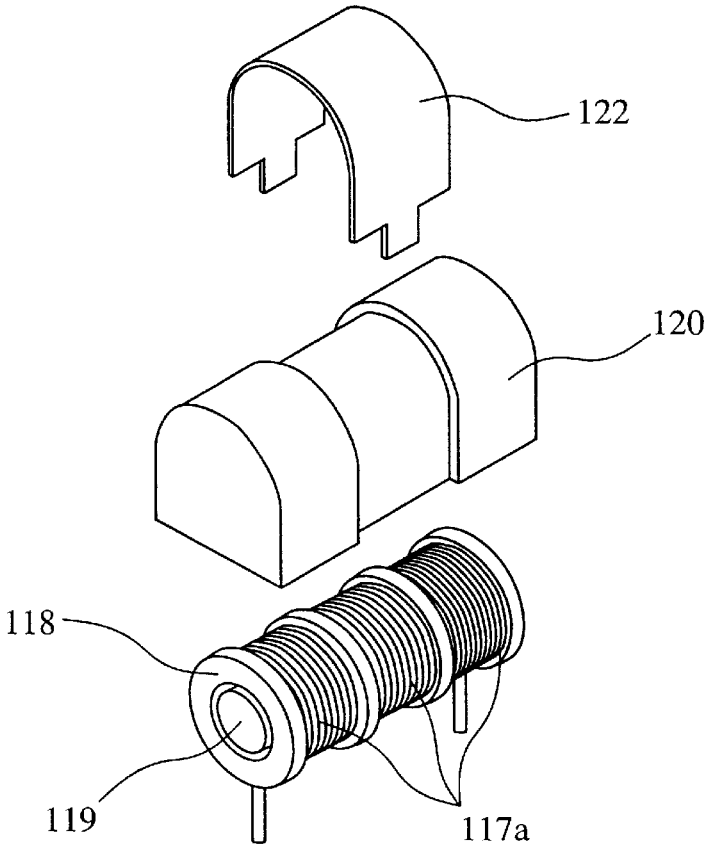
FIG. 19 Prior Art
FIG. 19 is a schematic perspective view showing a conventional transformer for use in a metal halide lamp circuit.

The high voltage transformer of the present invention is preferably used in a discharge lamp circuit, in particular, a metal halide lamp circuit for automotive headlights. A circuit diagram of a typical metal halide lamp circuit including the transformer of the present invention is shown in FIG. 15.

The present invention will be further described while referring to the following Examples which should be considered to illustrate various preferred embodiments of the present invention.

EXAMPLE 1

Figure 3:
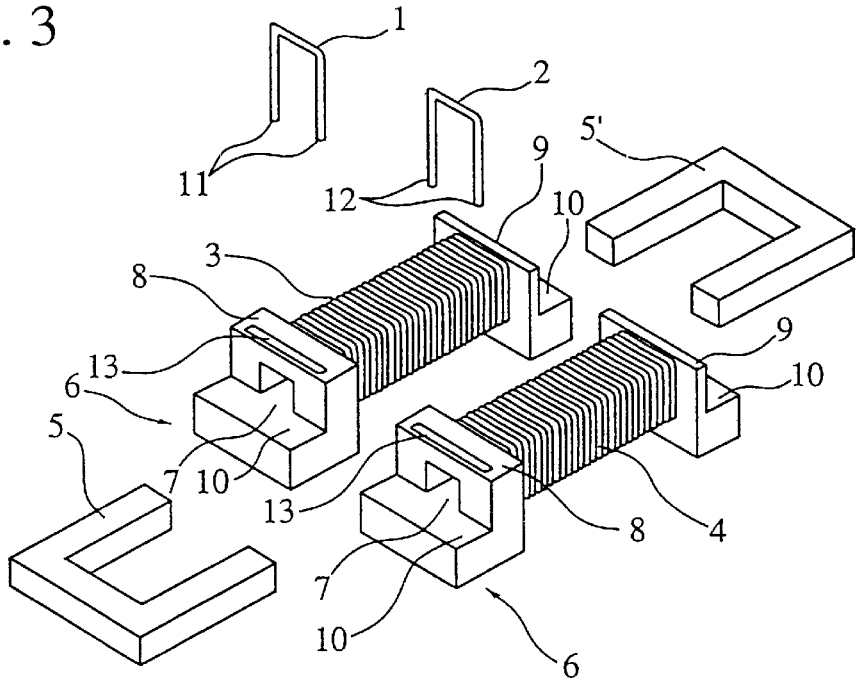
FIG. 3 is a perspective view showing the parts for the transformer of Example 1.
Figure 4:
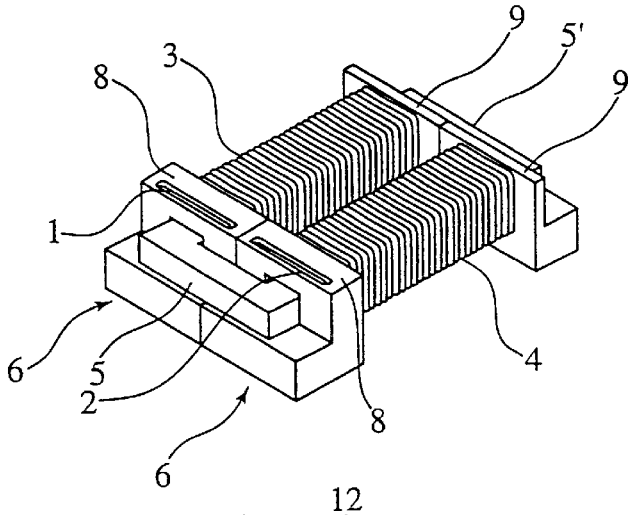
FIG. 4 is a perspective view showing the high voltage transformer assembled in Example 1.
Figure 5:
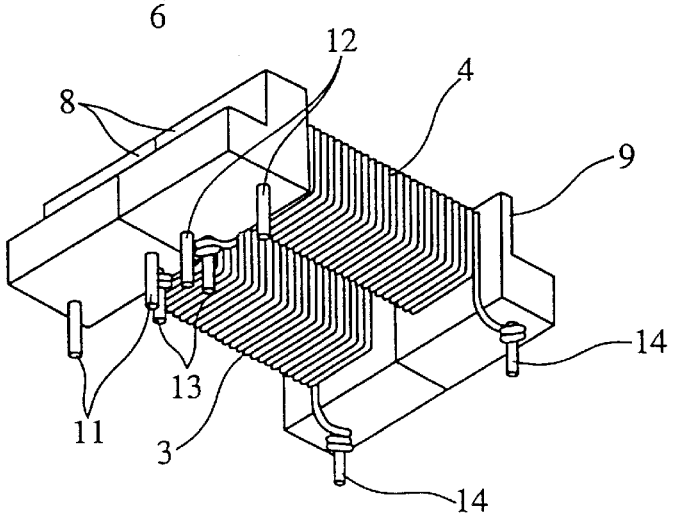
FIG. 5 is a lower perspective view of the transformer of FIG. 4.

FIGS. 3 to 5 show a high voltage transformer embodied by the present invention. A rectangular core was formed by combining two U-shaped core parts 5, 5' made of an NiCuZn ferrite. On each of the side legs of the rectangular core, was mounted a bobbin 6 made of a phenol resin. The bobbin 6 had a hollow through hole 7 to receive the side leg of the core parts 5, 5', a low voltage side flange 8 and a high voltage side flange 9 at both the ends thereof. Each of flanges 8, 9 had an outer recess 10 for supporting the core parts 5, 5'. The wall of the flange 8 at the input side was thicker than that of the flange 9, and had a slot 13 to which a ¾ turn primary coil 1 or 2 made of an conductive material having a diameter of 0.8 mm was inserted. Between the flanges 8 and 9, a 105-turn secondary coil 3 or 4 of single layer was regularly and orderly wound using UEW wire (polyurethane enameled magnet wire) having a diameter of 0.2 mm. The secondary coils 3 and 4 were wound in opposite directions to ensure that the opposing turns with the shortest distance were kept equipotential to prevent the discharge between the turns. The lower ends of the primary coils 1 and 2 passed through the flange 8 to serve as terminals 11 and 12. One of the ends (lower voltage side) of the secondary coils 3 and 4 was connected to a terminal 13, and the other end (high voltage side) was connected to a terminal 14.

The high voltage transformer having the above construction produced a secondary voltage of 20 kV from a primary voltage of 1 kV. During the operation, the secondary coil producing 20 kV was well insulated by the wall of the bobbin 6 and the flanges 8 and 9, and the primary coil was well insulated by the thick wall of the flange 8.

Since the secondary coil was regularly and orderly wound to minimize the potential difference between the adjacent turns, no discharge between the turns was not found. Further, since the opposite winding direction and the same number of turns of the secondary coils 3 and 4 kept the opposing turns with the shortest distance equipotential, no discharge between the opposing turns was found.

The same type transformer produced by changing the core material to NiZn ferrite, MgZn ferrite or MnMgZn ferrite showed the same results as above. Further, it was confirmed that the transformer having a rectangular core made of a U-shaped core part and an I-shaped core part, or two L-shaped core parts showed the same results as above.

EXAMPLE 2

Figure 9:
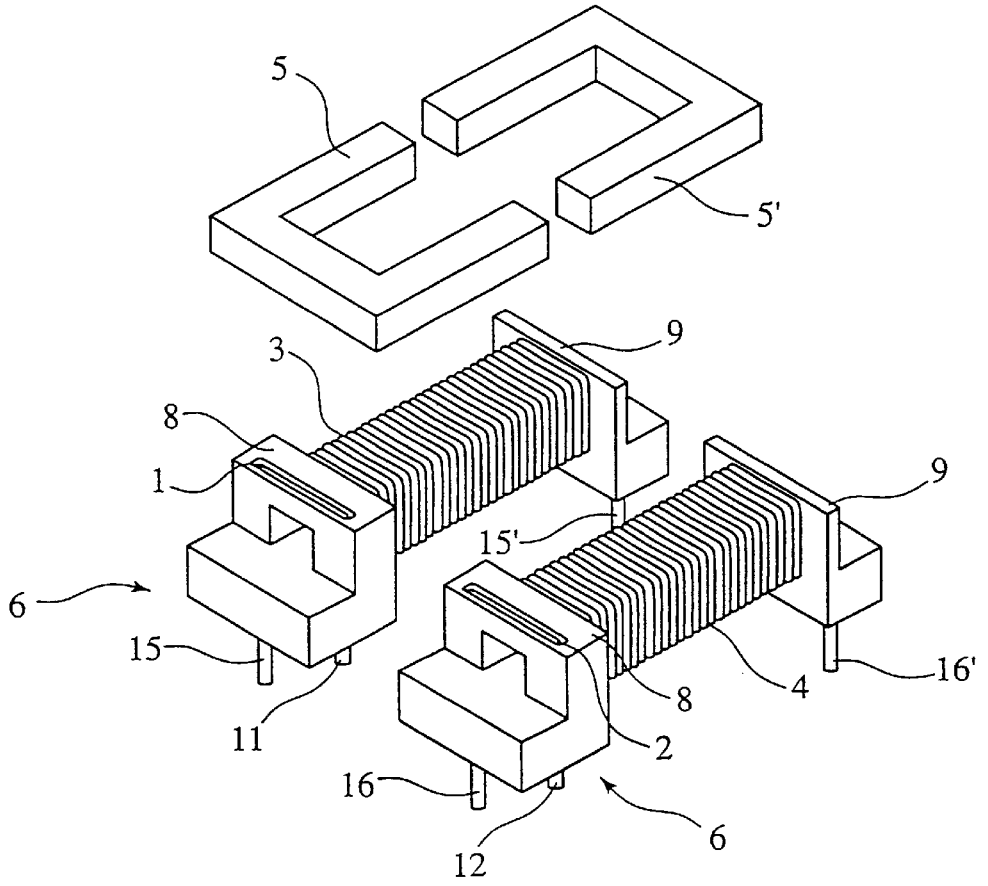
FIG. 9 is a perspective view showing another high voltage transformer of the present invention.
Figure 10:
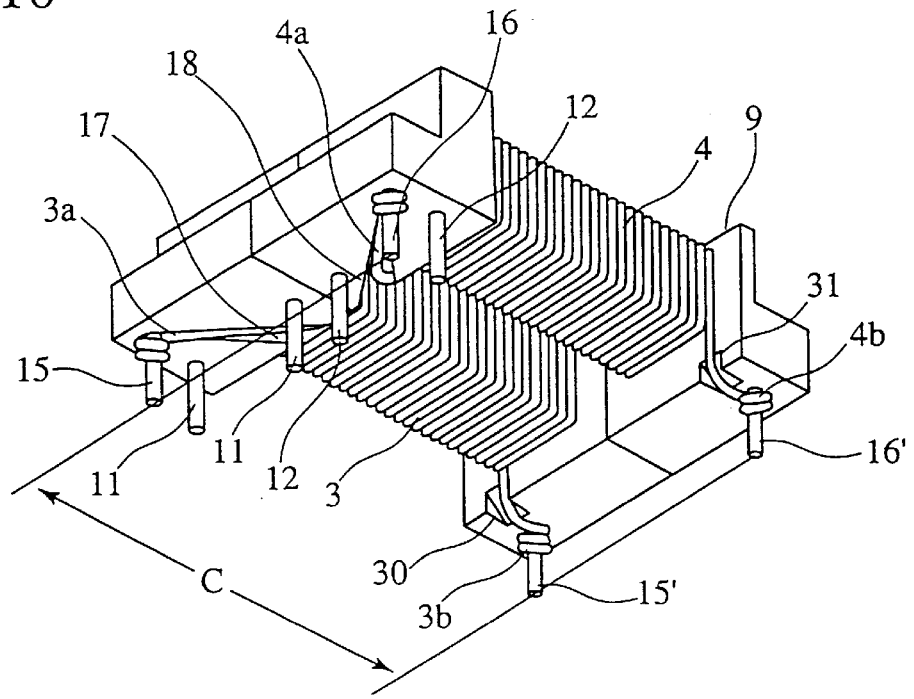
FIG. 10 is a lower perspective view of the transformer of FIG. 9.

The high voltage transformer shown in FIGS. 9 and 10 is basically the same as that shown in FIGS. 3 to 5. In this embodiment, second coil terminals 15, 15', 16 and 16' were placed so that the second coil terminals 15 and 15' and the second terminals 16 and 16' were sufficiently separated by a distance C, thereby ensuring the insulation between low voltage ends 3*a*, 4*a* and high voltage ends 3*b* , 4*b* of the secondary coils 3 and 4.

More specifically, the terminals 15, 16 to which the low voltage ends 3*a*, 4*a* were connected were disposed on one end portion of the bobbin 6, and the terminals 15', 16' to which the high voltage ends 3*b* , 4*b* were connected through grooves 30, 31 were disposed on the other end portion of the bobbin 6.

In the conventional transformer, both the terminals of the secondary coil are provided on the same end portion of the bobbin. Therefore, the bobbin must have a broader width for separating the terminals by a sufficient distance to ensure the insulation between the terminals. This makes the size of transformer unfavorably larger. However, in this embodiment, since the terminals are well insulated to each other by placing the terminals on the separate end portions of the bobbin, the bobbin is not required to have a broader width.

When the terminals 15, 16 are placed inside the terminals 11, 12 of the primary coil, a thick wall of the flange 8 is required, thereby increasing the size of the bobbin. This problem has been solved by placing the terminals 15, 16 outside the terminals 11, 12.

Further, as shown in FIG. 10, since the low voltage ends 3*a*, 4*a* of the secondary coils 3, 4 are guided to the terminals 15, 16 through grooves 17, 18, the insulation between the terminals 11, 12 of the primary coils and the low voltage ends 3*a*, 4*a* is enhanced.

EXAMPLE 3

Figure 12:
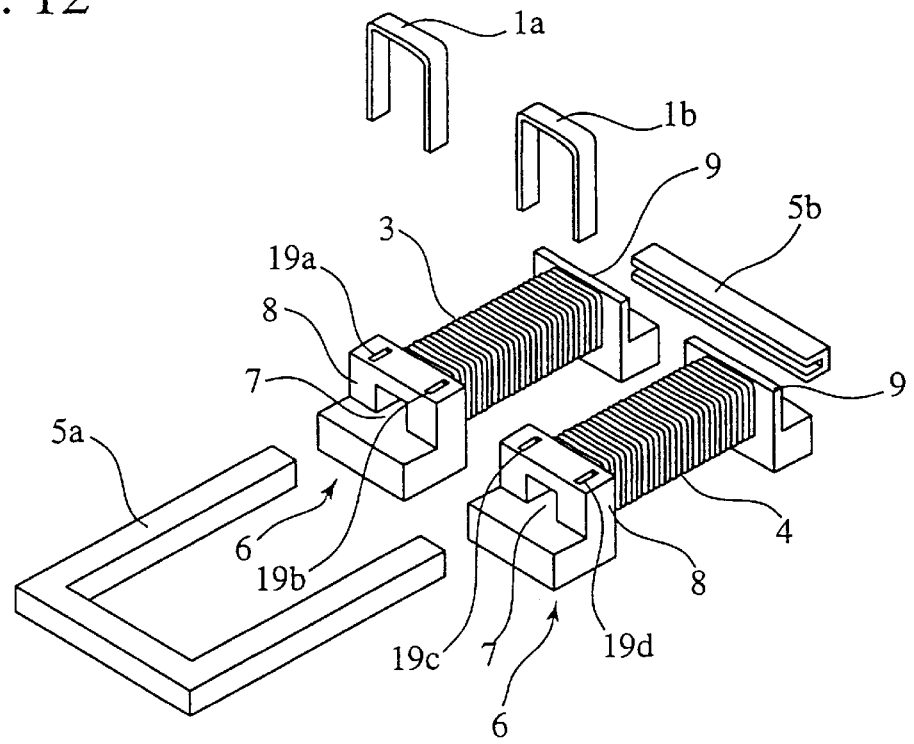
FIG. 12 is a perspective view showing another high voltage transformer of the present invention.

The transformer shown in FIG. 12 is basically the same as that shown in FIGS. 3 to 5. In this embodiment, a conductive thin plate 1*a*, 1*b* was used as the primary coil, which was inserted into slots 19*a*, 19*b*, 19*c*, 19*d* on the flange 8. By using the conductive thin plate 1*a*, 1*b*, a large quantity of current can be utilized.

Further the rectangular core was made from a U-shaped core part 5*a* and an I-shaped core part 5*b*. The I-shaped core part 5*b* has a groove extending along the length direction thereof to provide the transformer with L-type non-linear superposing characteristics.

EXAMPLE 4

Figure 13:
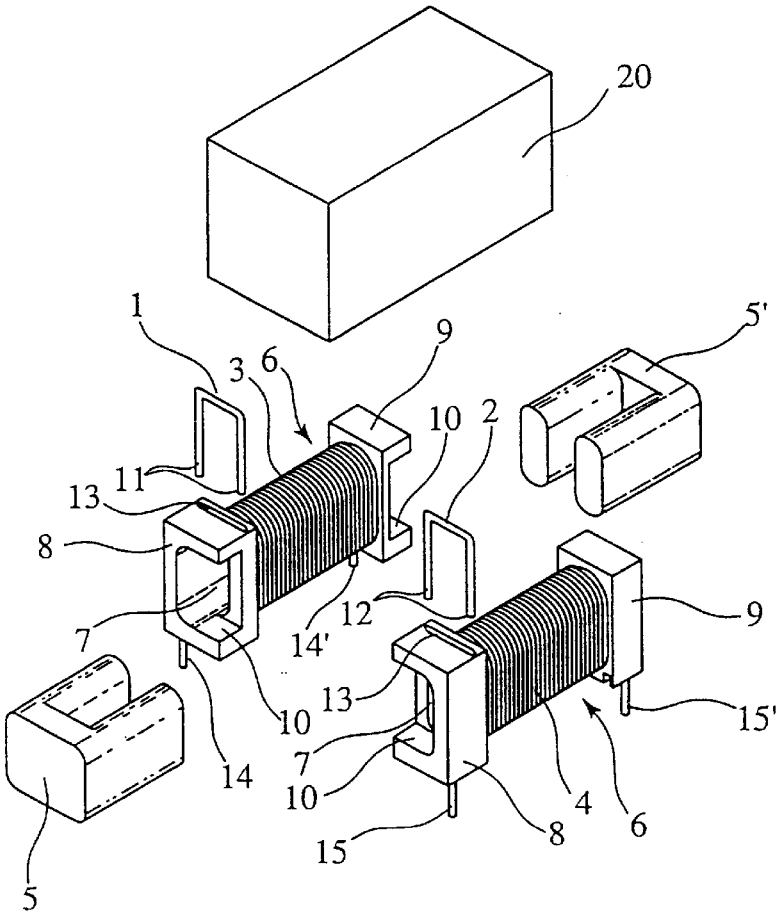
FIG. 13 is a perspective view showing another high voltage transformer of the present invention.
Figure 14:
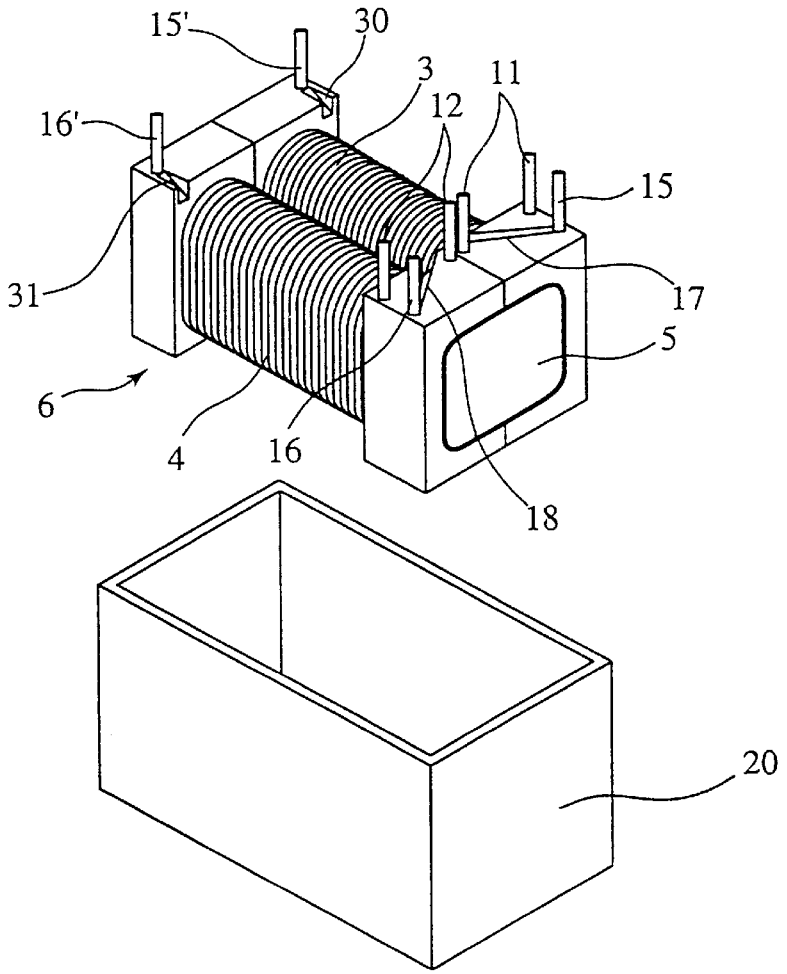
FIG. 14 is another perspective view showing the high voltage transformer of FIG. 13.

FIGS. 13 and 14 show a high voltage transformer to be sealed in an insulating casing 20 (25 mm×40 mm×25 mm (height)). The principal portions of the transformer of FIGS. 13 and 14 are basically the same as those of FIGS. 3 to 5. The assembled transformer was inserted into the casing 20 and sealed therein with an insulating resin.

The transformer thus obtained produced an output voltage of 20 kV from an input voltage of 1 kV, and was confirmed to be suitably used as the transformer for a metal halide lamp circuit.

What is claimed is:

1. A high voltage transformer comprising;

a core with a closed magnetic flux path formed by at lease two core parts, said core having at least two parallel side legs;

at least two bobbins mounted on said at least two side legs, said bobbin comprising a hollow through hole to receive said side leg, a low voltage side flange and a high voltage side flange at end portions of said bobbin;

a primary coil inserted in said low voltage side flange of each of said at least two bobbins; and a secondary coil regularly and orderly wound on each of said at least two bobbins between said low voltage side flange and said high voltage side flange, a winding direction of the secondary coil wound on one of said at least two bobbins being opposite to that of the secondary coil wound on the other bobbin.

2. The high voltage transformer according to claim 1, wherein said secondary coil is wound in a single layer.

3. The high voltage transformer according to claim 1, wherein said secondary coil is wound in a plurality of layers of single-layered regularly and orderly wound coils, said single-layered coils being connected in parallel.

4. The high voltage transformer according to claim 3, wherein said plurality of layers of single-layered coils comprises a flat parallel wire integrally formed from at least two wires, said flat parallel wire being edgewisely wound on said bobbin.

5. The high voltage transformer according to claim 1, wherein said primary coil is about ¾ turn.

6. The high voltage transformer according to claim 1, exhibiting non-linear direct-current superposing characteristics.

7. The high voltage transformer according to claim 1, wherein an output voltage of said high voltage transformer is 10 to 50 kV.

8. The high voltage transformer according to claim 1, wherein said high voltage transformer is used in a discharge lamp circuit.

9. The high voltage transformer according to claim 8, wherein said discharge lamp is a metal halide lamp.

10. The high voltage transformer according to claim 1, wherein said core is made of an NiZn ferrite.

11. The high voltage transformer according to claim 1, wherein a part of said core has an increased magnetic resistance.

12. The high voltage transformer according to claim 1, wherein an assembly comprising said core, at least two bobbins, at least two primary coils and at least two secondary coils is sealed in an insulating casing with an insulating resin.

13. The high voltage transformer according to claim 1, wherein said primary coil is a thin plate made of a conductive material.

* * * * *